US007676941B2

(12) United States Patent
Cruz et al.

(10) Patent No.: US 7,676,941 B2
(45) Date of Patent: Mar. 16, 2010

(54) CHALK LINE OR STRING ATTACHMENT CLAMP FOR MARKING LINES (STRAIGHT ANGLED OR RADIUS) ON FLAT SURFACES

(76) Inventors: Albert Peter Cruz, 1151 N. Richmond, Wichita, KS (US) 67203; John Charles Cruz, 3531 Lanell, Bossier City, LA (US) 71112

( * ) Notice: Subject to any disclaimer, the term of this patent is extended or adjusted under 35 U.S.C. 154(b) by 74 days.

(21) Appl. No.: 11/503,138

(22) Filed: Jun. 19, 2008

(65) Prior Publication Data

US 2008/0282563 A1 Nov. 20, 2008

(51) Int. Cl.
*B44D 3/38* (2006.01)

(52) U.S. Cl. ..... 33/414

(58) Field of Classification Search ..... 33/414, 33/413, 755, 756, 758, 770
See application file for complete search history.

(56) References Cited

U.S. PATENT DOCUMENTS 5,937,532 A * 8/1999 Eirich et al. ..... 33/758
6,082,014 A * 7/2000 Beyers ..... 33/414
6,931,743 B1 * 8/2005 Scarborough ..... 33/414
7,506,454 B1 * 3/2009 Balliet ..... 33/414
2002/0026723 A1 * 3/2002 Savalla ..... 33/414
2009/0133275 A1 * 5/2009 Wilson ..... 33/414
2009/0277027 A1 * 11/2009 Grisham ..... 33/414

* cited by examiner

*Primary Examiner*—Yaritza Guadalupe-McCall

(57) ABSTRACT

The chalk line attachment clamp is a new approach to snapping a chalk line on a flat surface such as plywood, sheetrock and other construction materials. It holds the chalk line at the specific desired location and allows one person to make an accurate straight line to cut the flat surface material at any angle, thereby saving man-hours at the same time improving the accuracy of the saw cut to allow a better fitting of the parts being cut and improving the quality of the assembled project. The old method of requiring one worker at each end of the chalk line is no longer necessary. It will not be required to damage the material by driving a nail into the material to hold a chalk line in place.

7 Claims, 2 Drawing Sheets

Figure 1:
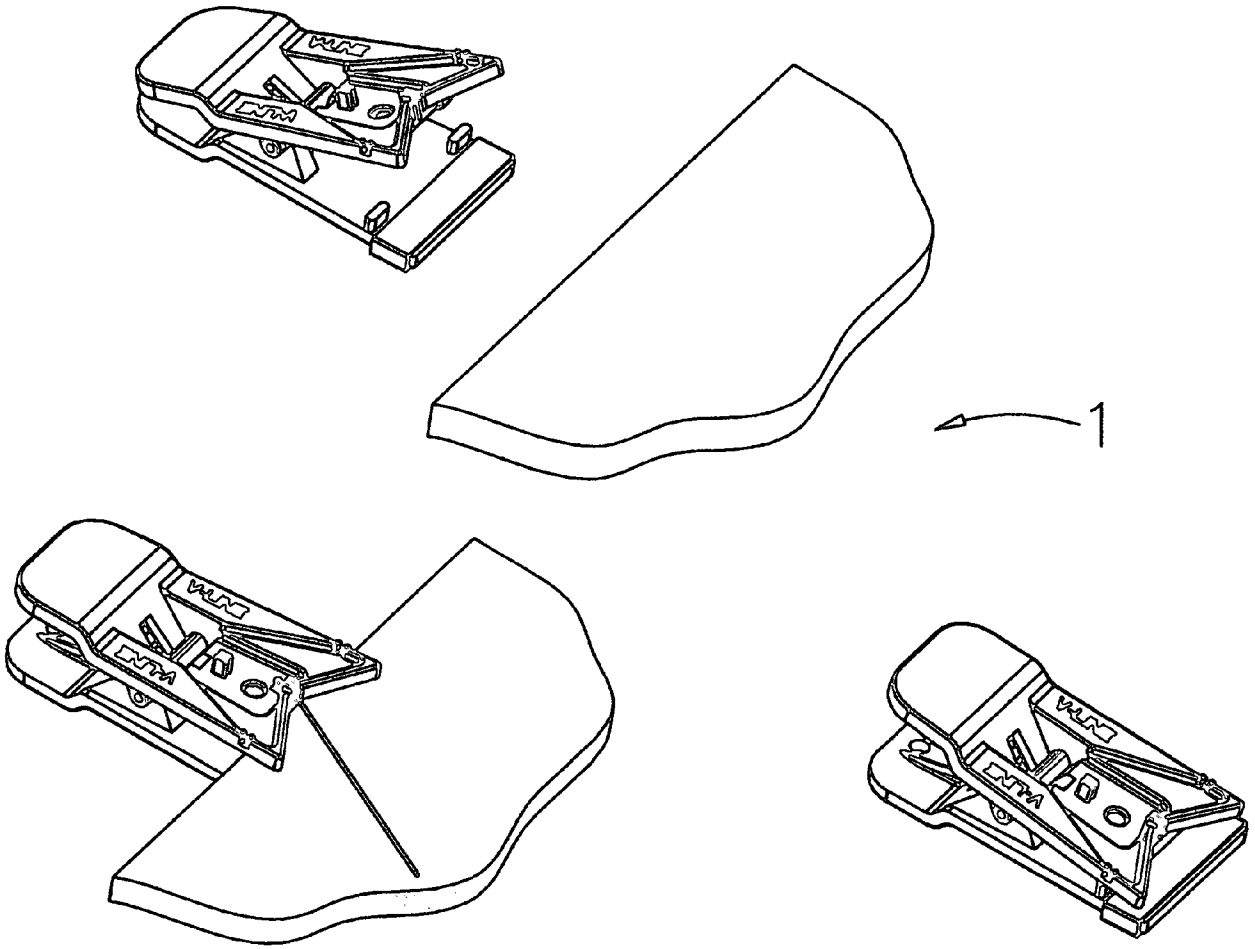
Figure 2:
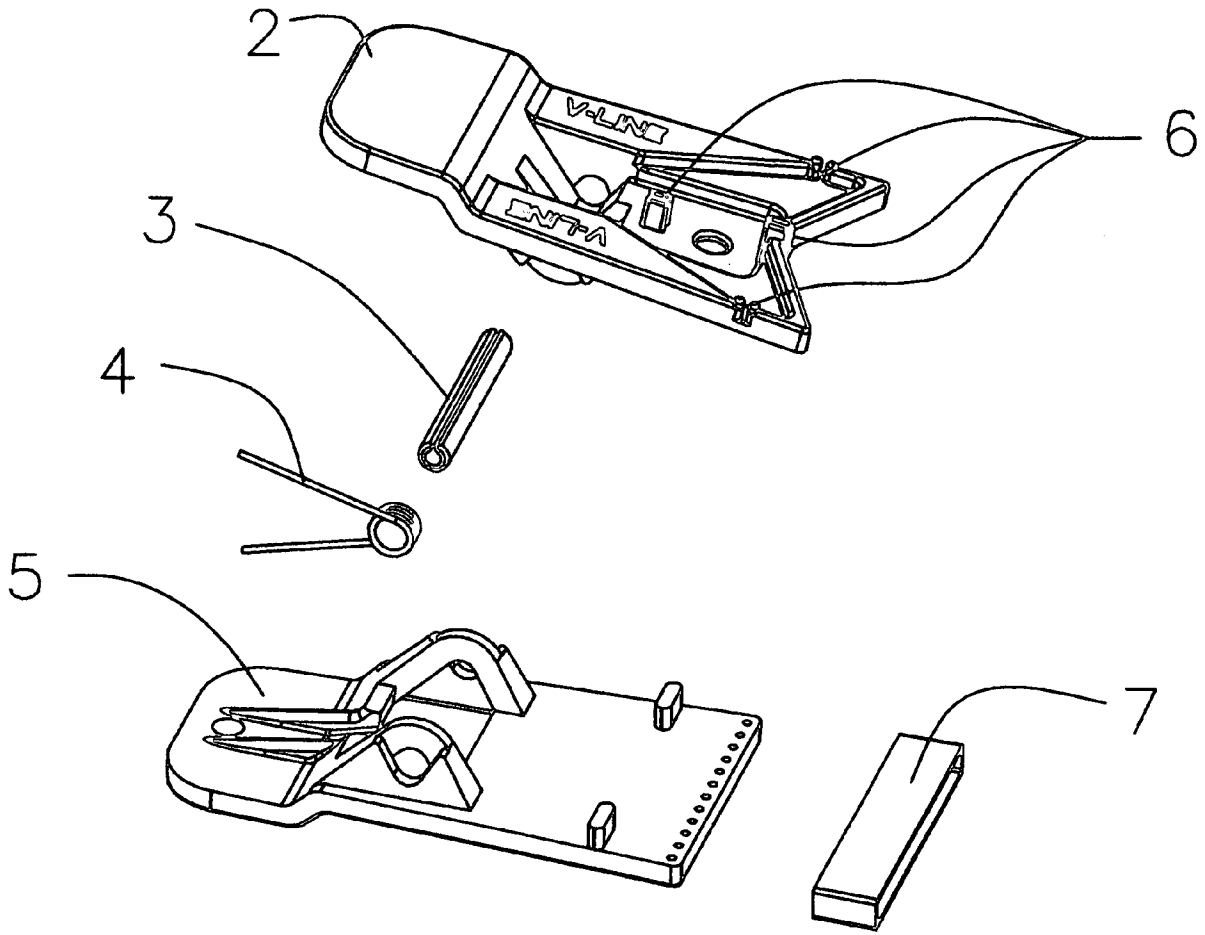

CHALK LINE OR STRING ATTACHMENT CLAMP FOR MARKING LINES (STRAIGHT ANGLED OR RADIUS) ON FLAT SURFACES

CROSS-REFERENCE TO RELATED APPLICATION

Claims priority from Provisional Application 60/708,173

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The idea of this tool came to us out of pure necessity. In the twenty odd years of framing, I have always run into the same problem when cutting plywood at angles. The problem was making an accurate angle line mark without the help of either a nail or another person. I have tried many methods, but was not pleased with the results and came to the conclusion that I had to invent something to solve that problem. Other ways of marking plywood would be a straight edge, but more often than not, the straight edge would either be too long or too short. If it was too long when the line was marked, the straight edge would move or plywood would move. If it was too short, well, it just wouldn't reach from one end to the other. I tried clamping the line to the plywood. Since I would have to roll the line on the plywood, it created other problems: (a) it would not be accurate. (b) it would slip off the clamp. A nail would split the material and it too, was inaccurate and cause the line to have a tendency to run down the edge of the plywood on steeper angles.

BRIEF SUMMARY OF THE INVENTION

The chalk line attachment clamp solved all of the problems I came across. One simply clamps the tool to the plywood (or any outer flat surface measuring from a quarter inch to seven eights inch). Align the line guide with your mark, lay the line in the line guides and pull to the other mark and snap the chalk line.

You will notice there is a line guide closer to the spring. It is there to bring the end of the line further from the end, thus ensuring the chalk goes right to the edge. (Not all chalk lines do this.) Our invention makes it possible to mark lines on various sheets of plywood, stucco board, sheetrock, sheets of 4×8 siding—just about anything with an elevated, flat surface.

FIG. 1

Top View: The top view shows the chalk line attachment in an open position.

Bottom Left: The bottom left view shows the chalk line attachment clamp in the desired position, with a chalk line attached.

Bottom Right: The bottom right view shows the chalk line attachment clamp at rest when not is use.

FIG. 2

#2 shows the upper part of the tool which is made of glass bead plastic.

#3 is the roll pin used to connect upper and lower parts and retain the spring in position.

#4 is the spring used to apply tension to the upper and lower parts and hold roll pin in place.

#5 shows the lower part of the tool also made of glass bead plastic.

#6. Identifies the various line guides used to snap the desired angle.

#7. Gripping band is a non-slip rubber composite material.

DETAILED DESCRIPTION OF THE INVENTION

Our invention is comprised of five parts:

1. The two main parts consist of the upper and lower parts of the clamp. The clamp, being made of a very hard glass bead plastic is then poured into the design mold. The upper part has the line guide and is the top of the tool. It has one main line guide which is the line closest to the spring. The next line guide is the center line guide and is located in the front center of the upper part. It is the most commonly used guide. The center guide is used to align the tool with the target mark for the beginning of the desired chalk line. There are also two side line guides to allow a steeper angle by aligning the side line guide with the target mark for the beginning of the desired chalk line. The lower edge guide is located immediately below the center guide on the bottom side of the upper part, is an edge guide used to align the tool against the material being marked.

2. The lower part (or the bottom half) is used to stabilize the tool onto the material, such as plywood, and has the most clamping surface against the material. The upper edge guide is located on the top of the lower part parallel to the edge guide of the upper part described above.

3. The gripping band is attacked to the front of the lower part described above. The purpose of gripping band is to provide a non-slip grip on the material.

4. The roll pin consists of a commercially available roll pin that is used to connect the upper and lower parts. The roll pin also is used to retain the spring described below:

5. The tension spring is commercially available and provided adequate tension to hold the tool in place. It also keeps the tool in closed position when not in use.

What is claimed is:

1. A line holder clamp for marking work pieces with a chalk line consisting of:

(1) opposing upper and lower jaws, each having a gripping end portion and a free end portion;

(2) wherein said free end portion of said upper jaw has a ridged, V-shaped end including a recess at the apex configured to accommodate a line;

(3) said opposing upper and lower jaws being pivotably hinged and assembled with a closed tension helical spring and roll pin for manually opening and closing the gripping end portions by squeezing the free end portions toward one another; and (4) said upper and lower jaws including raised stop blocks integrated to an inside surface of the jaws and are perpendicular to the center.

2. A line holder clamp according to claim 1 further including a split top placement face for clearance and precision indexing of work piece marker-chalk line.

3. A line holder clamp according to claim 1 wherein said recess in the upper jaw includes a channeled line guide tabs arranged at different angles for securing said line or measuring tape end and suitably designed to ensure said line is secure within the tabs.

4. A line holder clamp according to claim 1 further including a gripping band to enhance the friction when gripping the work piece.

5. A line holder clamp according to claim 1 wherein said upper jaw further includes a pocket in the center for thumb placement and a thru hole for retaining a marker.

6. A line holder clamp according to claim 1 wherein said lower jaw further includes a thru hole for hanging and/or securing the clamp to a surface.

7. A line holder clamp according to claim 1 wherein said upper and lower jaws are sized to accommodate a work piece of at least ¼ to ⅞ inches and up to 1½ inches thick.

* * * * *